US010040585B1

(12) United States Patent
Yu Chen

(10) Patent No.: US 10,040,585 B1
(45) Date of Patent: Aug. 7, 2018

(54) CABLE TIE TENSIONER

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 0 days.

(21) Appl. No.: 15/426,025

(22) Filed: Feb. 6, 2017

(51) Int. Cl.
*B65B 13/02* (2006.01)

(52) U.S. Cl.
CPC ..... *B65B 13/027* (2013.01); *B65B 13/025* (2013.01); *B65B 13/02* (2013.01)

(58) Field of Classification Search
CPC ..... B65B 13/02; B65B 13/18; B65B 13/22; B65B 13/025; B65B 13/027; B65B 13/185
See application file for complete search history.

(56) References Cited

U.S. PATENT DOCUMENTS 4,561,475 A * 12/1985 Hinden ..... B65B 13/027 140/123.5
5,372,166 A * 12/1994 Lai ..... B65B 13/027 140/123.6
6,962,108 B1 * 11/2005 Yu Chen ..... B65B 13/025 100/29
7,063,110 B2 * 6/2006 Chen ..... B65B 13/025 140/123.6
2012/0067450 A1 * 3/2012 Shafer ..... B65B 13/027 140/123.6

FOREIGN PATENT DOCUMENTS

FR 2206728 A5 * 6/1974 ..... B65B 13/025

OTHER PUBLICATIONS

EPO FR 2206728 A5 Translation, Dec. 2017.*

* cited by examiner

*Primary Examiner* — Pradeep C Battula
(74) *Attorney, Agent, or Firm* — Bruce Stone LLP; Joseph Bruce

(57) ABSTRACT

A cable tie tensioner includes a first plate body and a second plate body. The first plate body includes a first pivot portion, a first operation handle, and a cutting member. The second plate body includes a second pivot portion and a second operation handle corresponding to the first pivot portion and the first operation handle. The second plate body is provided with a pressing member. When in use, a tie section of a cable tie is inserted through the pressing member, the second operation handle is operated to move toward the first operation handle, and the pressing member clamps the excessive tie section of the cable tie to be pulled so that an article can be tied up. After the article is tightened, the cutting member is used to cut off the excessive tie section of the cable tie.

10 Claims, 4 Drawing Sheets

CABLE TIE TENSIONER

FIELD OF THE INVENTION

The present invention relates to a tensioner, and more particularly to a cable tie tensioner.

BACKGROUND OF THE INVENTION

A conventional cable tie has a connecting head. The connecting head has a perforation. An engaging tongue is provided in the perforation, one end of the engaging tongue is fixed inside the perforation to form a fixed end. The other end of the engaging tongue extends out of the perforation to form a free end. The engaging tongue is provided with a first toothed portion. One side of the connecting head of the conventional cable tie is provided with a tie. The tie is formed with a plurality of second toothed portions thereon. The tie is used to wrap the outer periphery of an article, and then the tie is inserted through the perforation. The first toothed portion meshes with the second toothed portions to position the tie so that the article can be tied up.

However, it is not easy to tighten the articles with the conventional cable tie due to an insufficient applied force. The article may slip off the cable tie easily. In addition, the excessive tie is cut with a cutter after binding. The cable tie is thick, which makes the cutter blunt easily to cause inconvenience in use. Accordingly, the inventor of the present invention has devoted himself based on his many years of practical experiences to solve these problems.

SUMMARY OF THE INVENTION

The primary object of the present invention is to provide a cable tie tensioner which can tighten a cable tie in a labor-saving manner and cut off the excessive tie section of a cable tie.

In order to achieve the aforesaid object, the cable tie tensioner of the present invention comprises a first plate body and a second plate body. The first plate body includes a first pivot portion, a first operation handle, a fixed plate, and a cutting member. A retaining member is inserted through the fixed plate and the cutting member. The second plate body includes a second pivot portion and a second operation handle corresponding to the first pivot portion and the first operation handle. The second plate body is provided with a pressing member. The pressing member includes a pressing plate, a cover plate, and a pressing block. A pivot shaft is inserted through the second plate body, the pressing block, and the cover plate for pivoting the pressing block. The pivot shaft is sleeved with a spring. One end of the spring is connected to the second plate body, and another end of the spring is connected to the pressing block.

Thereby, when the cable tie tensioner is in a normal state, a free end of the retaining member is against the pressing block and a passage is formed between the pressing block and the pressing plate. When the second operation handle is operated to move toward the first operation handle, the spring brings the pressing block to press the pressing plate so that the pressing member clamps a tie section of a cable tie to be pulled for the cable tie to tighten an article. After the article is tied up, the cutting member is used to cut off the excessive tie section of the cable tie.

DETAILED DESCRIPTION OF THE PREFERRED EMBODIMENTS

Embodiments of the present invention will now be described, by way of example only, with reference to the accompanying drawings.

Figure 1:
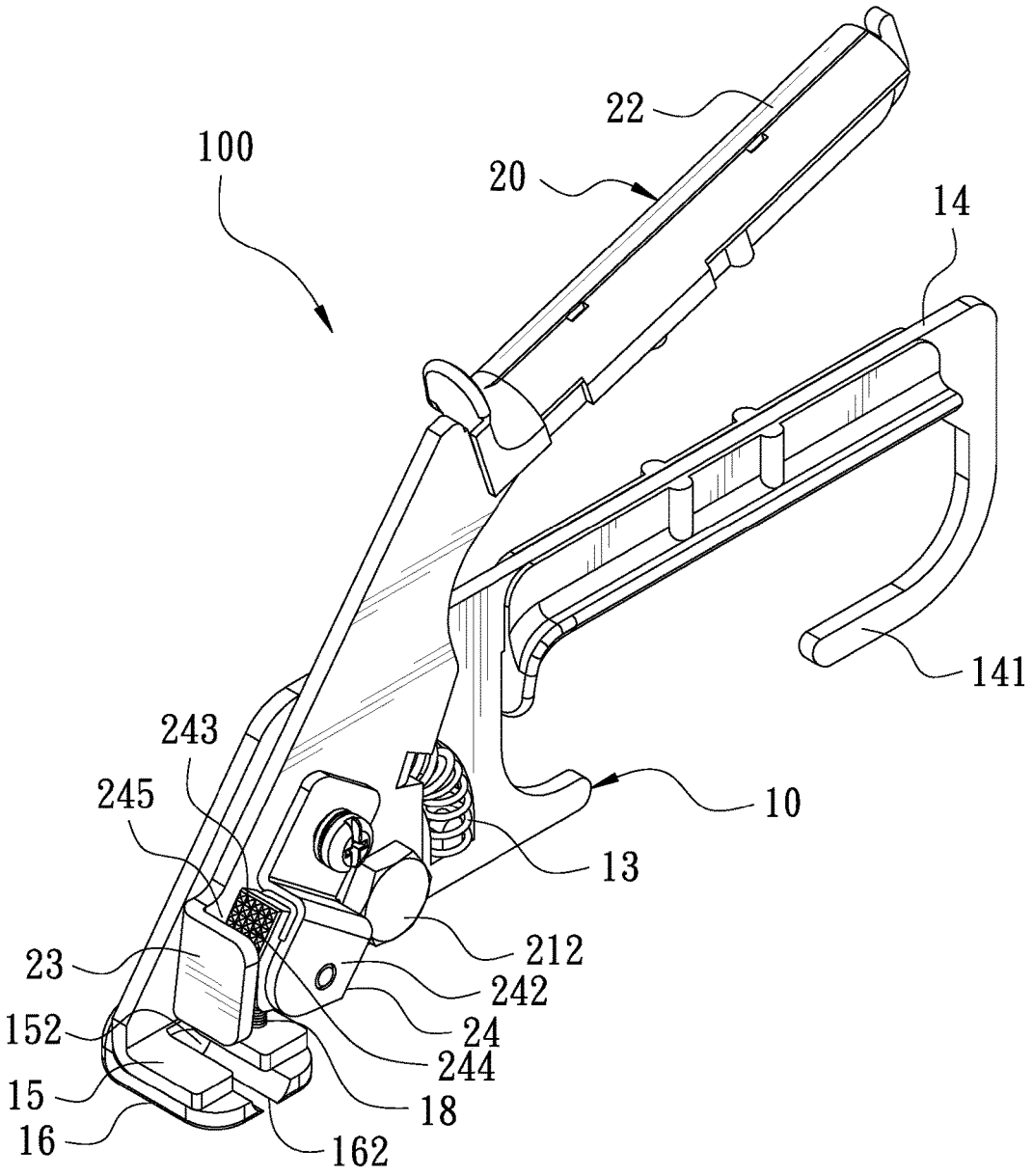
FIG. 1 is a perspective view of the present invention.
Figure 2:
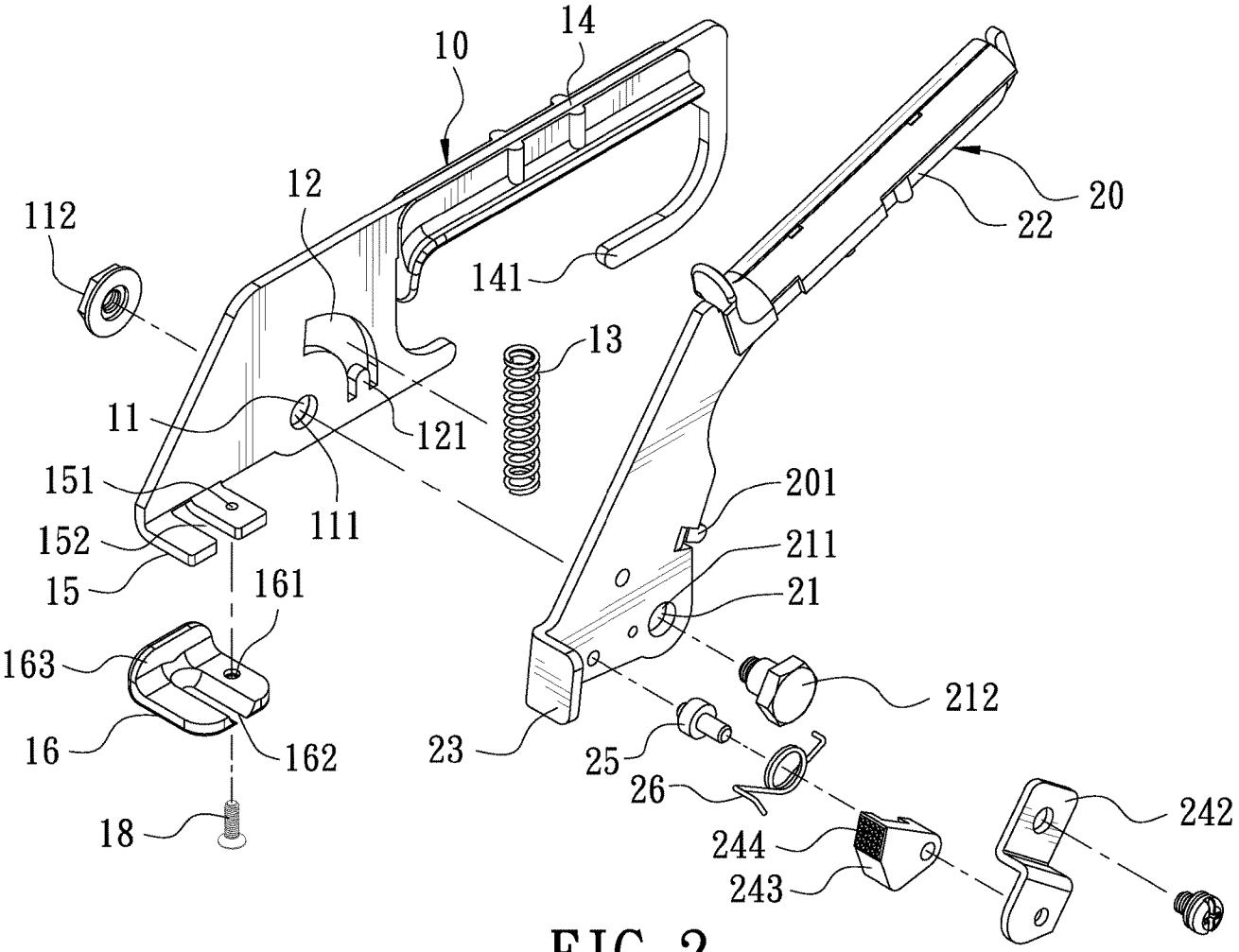
FIG. 2 is an exploded view of the present invention.

FIG. 1 is a perspective view of the present invention. FIG. 2 is an exploded view of the present invention. The present invention discloses a cable tie tensioner 100. The cable tie tensioner 100 comprises a first plate body 10 and a second first plate body 20.

The first plate body 10 includes a first pivot portion 11. The first pivot portion 11 has a first pivot hole 111. The first plate body 10 has an accommodation groove 12 beside the first pivot portion 11. The accommodation groove 12 is provided with a return spring 13. One side of the accommodation groove 12 is provided a first flange 121. One end of the return spring 13 is engaged with the first flange 121. A first end of the first plate body 10 is provided with a first operation handle 14. The first operation handle 14 is provided with a hook 141. A second end of the first plate body 10 is integrally formed with a fixed plate 15. One side of the fixed plate 15 is provided with a cutting member 16. Another side of the fixed plate 15 is provided with a retaining member 18. The fixed plate 15 and the cutting member 16 have perforations 151, 161, respectively. The first plate body 1 is provided with the retaining member 18 inserted in the perforation 151 of the fixed plate 15 and the perforation 161 of the cutting member 16. In this embodiment of the present invention, the retaining member 18 is a screw. A fixed end of the retaining member 18 is secured to the cutting member 16. A free end of the retaining member 18 is inserted through the fixed plate 15. The fixed plate 15 has a through groove 152. The cutting member 16 has a concave groove 162 corresponding to the through groove 152. Two side walls of the concave groove 162 are formed with cutting edges. The cutting member 16 further has a side plate 163. The cutting member 16 is held against the first plate body 10 through the side plate 163.

The second plate body 20 includes a second pivot portion 21 and a second operation handle 22 corresponding to the first pivot portion 11 and the first operation handle 14. The periphery of the second plate body 20, corresponding to another side of the accommodation groove 12, is provided with a second flange 201. Another end of the return spring 13 is engaged with the second flange 201. The second pivot portion 21 has a second pivot hole 211. The first pivot hole 111 and the second pivot hole 211 are provided with a pivot rod 212. A free end of the pivot rod 212 is inserted through the first pivot hole 111 and provided with a fixing member 112. The fixing member 112 is a nut. The second plate body 20 is provided with a pressing plate 23 and a pressing member 24. The second plate body 20 integrally provided with a pressing plate 23. The pressing member 24 includes a cover plate 242 and a pressing block 243. The cover plate 242 is fixed to the second plate body 20 and covers the pressing block 243. The pressing block 243 is located between the second plate body 20 and the cover plate 242. The pressing block 243 has a bite surface 244 corresponding to the pressing plate 23. The bite surface 244 is serrated. A pivot shaft 25 is inserted through the cover plate 242, the pressing block 243, and the second plate body 20 for pivoting the pressing block 243. The pivot shaft 25 is sleeved with a spring 26. One end of the spring 26 is connected to the second plate body 20 and another end of the spring 26 is connected to the pressing block 243, such that the pressing block 243 has a prestressing force in the direction of the pressing plate 23.

Thereby, in a normal state, the pressing block 243 is against the free end of the retaining member 18, so that a passage 245 is formed between the pressing block 243 and the pressing plate 23. When the user grasps the first operation handle 14 and the second operation handle 22 tightly, the pressing block 243 is pressed against the pressing plate 23.

Figure 3:
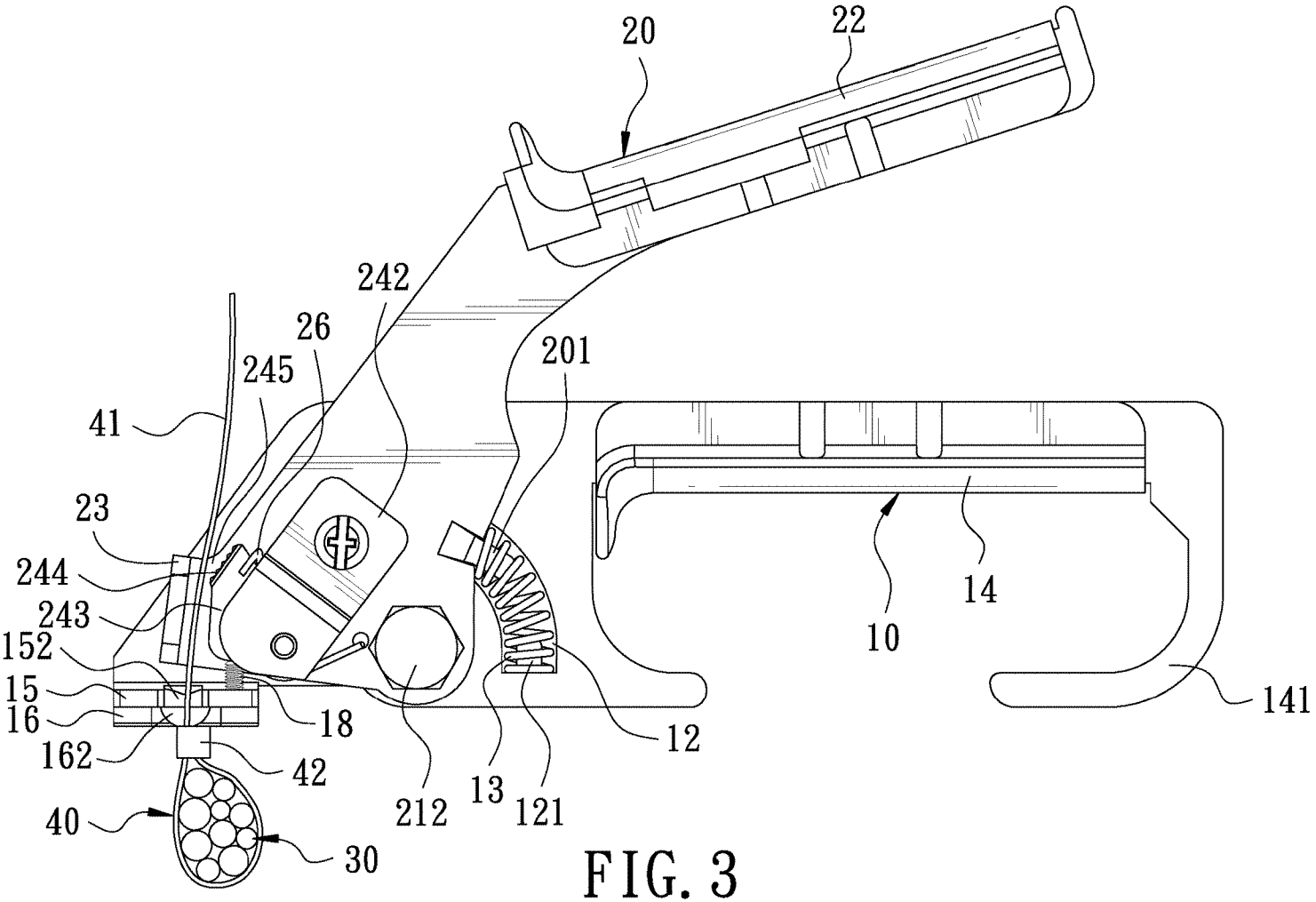
FIG. 3 is a schematic view of the present invention when in use, showing that the first operation handle and the second operation handle are released in a normal state.
Figure 4:
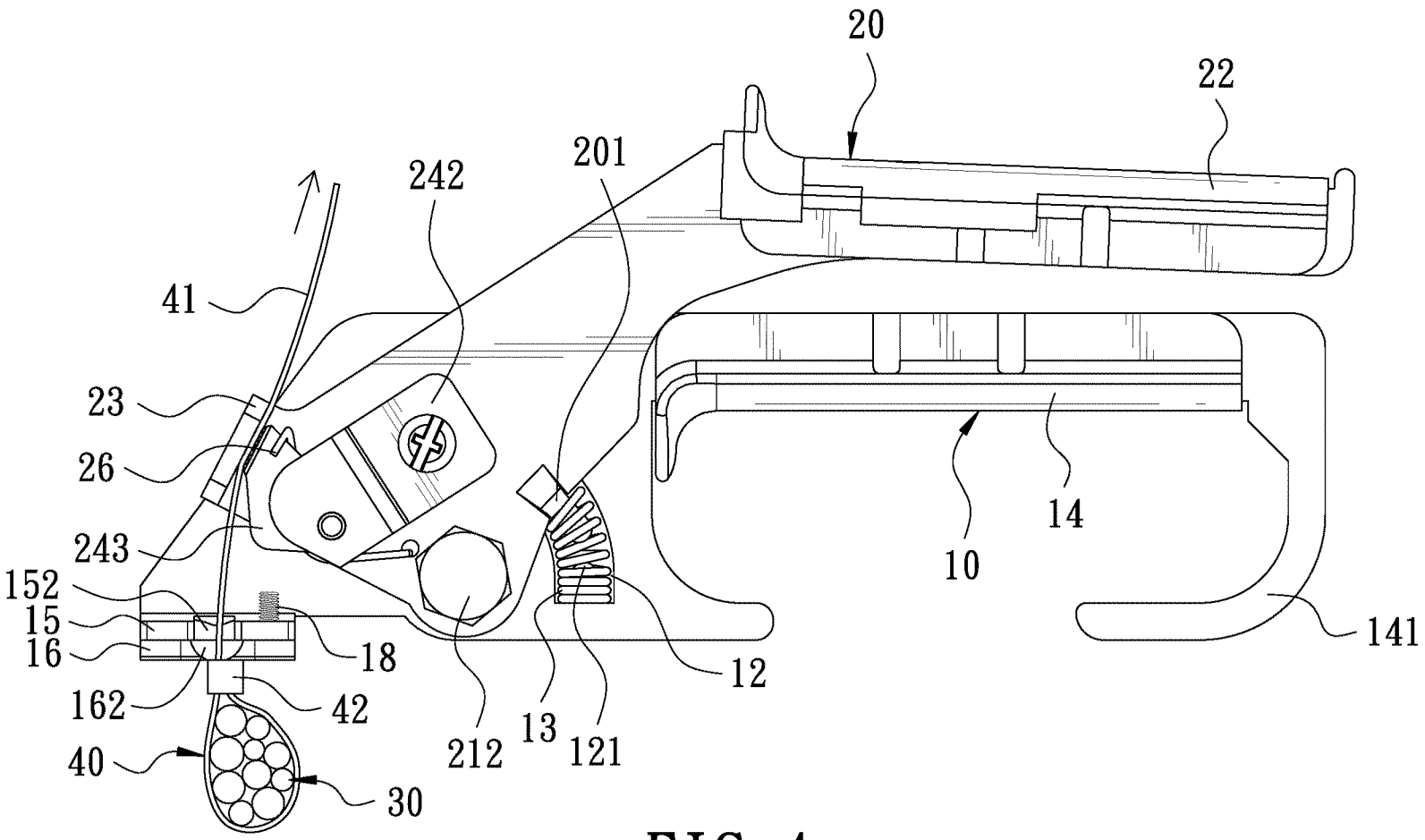
FIG. 4 is a schematic view of the present invention when in use, showing that the second operation handle is pressed to move toward the first operation handle.

Referring to FIG. 3 and FIG. 4, when the cable tie tensor 100 is used, the user first wraps an article 30 with a cable tie 40. The cable tie 40 has a tie section 41 and a pawl head 42. The tie section 41 is formed with a toothed portion. The excessive tie section 41 of the cable tie 40 is inserted through the concave groove 162, the through groove 152, and the passage 245. The cutting member 16 holds against the pawl head 42, and then the first operation handle 14 and the second operation handle 22 are pressed so that the pressing block 243 is moved away from the retaining member 18. At this time, the prestressing force of the spring 26 urges the pressing block 243 to press against the pressing plate 23. The bite surface 244 of the pressing block 243 bites the toothed portion. The pressing block 243 and the pressing plate 23 clamp the tie section 41 tightly to pull the excessive tie section 41 so that the cable tie 40 further tightens the article 30. After that, the user releases the first operation handle 14 and the second operation handle 22. The return spring 13 is restored to its normal state. The free end of the retaining member 18 holds against the pressing block 243 so that the passage 245 between the pressing block 243 and the pressing plate 23 is formed again. The above-described operation is repeated so that the cable tie 40 tightens the article 30 firm. After the article 30 is tightened and fixed, the excessive tie section 41 is cut by rotating the cutting edge of the cutting member 16 at the position of the pawl head 42 to complete the tightening operation.

When the cutting edge of the cutting member 16 is blunt, the user can sharpen the cutting edge along the periphery of the concave groove 162; and when the cutting edge of the cutting member 16 is no longer usable, the cutting member 16 can be removed and replaced, thereby prolonging the service life of the cable tie tensioner 100.

Since the cover plate 242 covers the pressing block 243, the pivot shaft 25 and the spring 26 (please refer to FIG. 2), the pressing block 243, the pivot shaft 25 and the spring 26 will not get contact with the outside and be damaged when in use. The two ends of the pivot shaft 25 are connected to the cover plate 242 and the second plate body 20, respectively. When the spring 26 urges the pressing block 243 to press against the pressing plate 23, the prestressing force of the spring 26 is averaged to the bite surface 244 so that the bite surface 244 cooperates with the pressing plate 23 to clamp the tie section 41 tightly so as to make the tightening work more convenient and effective.

After the cable tie tensioner 100 is used, the hook 141 of the cable tie tensioner 100 can be hung on the user's belt or pocket for next use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A cable tie tensioner, comprising:

a first plate body, including a first pivot portion, a first end of the first plate body being provided with a first operation handle, a second end of the first plate body being provided with a fixed plate, one side of the fixed plate being provided with a removable cutting member, another side of the fixed plate being provided with a retaining member;

a second plate body, including a second pivot portion and a second operation handle corresponding to the first pivot portion and the first operation handle, the second plate body being provided with a pressing plate and a pressing member, the pressing member including a pressing block, a pivot shaft being inserted through the pressing block and the second plate body, the pivot shaft being sleeved with a spring, one end of the spring being connected to the second plate body and another end of the spring being connected to the pressing block, enabling the pressing block to have a prestressing force in the direction of the pressing plate;

thereby, in a normal state, the pressing block being against a free end of the retaining member to form a passage between the pressing block and the pressing plate, wherein when the first operation handle and the second operation handle are grasped tightly, the pressing block is pressed against the pressing plate.

2. The cable tie tensioner as claimed in claim 1, wherein the pressing member includes a cover plate, the cover plate covers the pressing block, and the pivot shaft is inserted through the cover plate, the pressing block, and the second plate body.

3. The cable tie tensioner as claimed in claim 1, wherein the first pivot portion has a first pivot hole, the second pivot portion has a second pivot hole, the first pivot hole and the second pivot hole are provided with a pivot rod, and a free end of the pivot rod is inserted through the first pivot hole and provided with a fixing member.

4. The cable tie tensioner as claimed in claim 1, wherein the first operation handle is provided with a hook.

5. The cable tie tensioner as claimed in claim 1, wherein the fixed plate and the cutting member each have a perforation.

6. The cable tie tensioner as claimed in claim 5, wherein the retaining member is a screw.

7. The cable tie tensioner as claimed in claim 1, wherein the fixed plate has a through groove, the cutting member has a concave groove corresponding to the through groove, and two side walls of the concave groove are formed with cutting edges.

8. The cable tie tensioner as claimed in claim 1, wherein the cutting member further has a side plate, and the cutting member is held against the first plate body.

9. The cable tie tensioner as claimed in claim 1, wherein the pressing block has a bite surface, and the bite surface is serrated.

10. The cable tie tensioner as claimed in claim 1, wherein the first plate body has an accommodation groove beside the first pivot portion, the accommodation groove is provided with a return spring, one side of the accommodation groove is provided a first flange, a periphery of the second plate body, corresponding to another side of the accommodation groove, is provided with a second flange, one end of the return spring is engaged with the first flange, and another end of the return spring is engaged with the second flange.

* * * * *